United States Patent [19]

Sawai et al.

[11] Patent Number: 4,886,435

[45] Date of Patent: Dec. 12, 1989

[54] SCROLL COMPRESSOR WITH INTERMITTENT OIL SUPPLY PASSAGE

[75] Inventors: Kiyoshi Sawai, Kusatsu; Shuuichi Yamamoto, Kyoto; Hiroshi Morokoshi, Yasu; Michio Yamamura; Shigeru Muramatsu, both of Kusatsu, all of Japan

[73] Assignee: Matsushita Electric Industrial Co., Ltd., Osaka, Japan

[21] Appl. No.: 167,844

[22] Filed: Mar. 14, 1988

[30] Foreign Application Priority Data

| | | | |
|---|---|---|---|
| Mar. 12, 1987 | [JP] | Japan | 62-57133 |
| Mar. 20, 1987 | [JP] | Japan | 62-66315 |
| Apr. 30, 1987 | [JP] | Japan | 62-106668 |

[51] Int. Cl.[4] ..... F04C 18/04; F04C 29/02

[52] U.S. Cl. ..... 418/55; 418/88; 418/94; 418/DIG. 1

[58] Field of Search ..... 418/55, 88, 94, DIG. 1; 417/902

[56] References Cited

U.S. PATENT DOCUMENTS

| | | | |
|---|---|---|---|
| 4,065,279 | 12/1977 | McCullough | 418/94 |
| 4,332,535 | 6/1982 | Terauchi et al. | 418/DIG. 1 |
| 4,637,786 | 1/1987 | Matoba et al. | 418/94 |

FOREIGN PATENT DOCUMENTS

| | | | |
|---|---|---|---|
| 60-116893 | 6/1985 | Japan | 418/94 |
| 61-40483 | 2/1986 | Japan | 418/DIG. 1 |
| 61-265375 | 11/1986 | Japan | 418/94 |
| 61-291793 | 12/1986 | Japan | 418/94 |

*Primary Examiner*—John J. Vrablik

*Attorney, Agent, or Firm*—Wenderoth, Lind & Ponack

[57] ABSTRACT

The present invention provides a low-pressure scroll compressor for use in a refrigerating system of an air conditioning apparatus or the like. Lubricating oil is intermittently supplied to a compressor unit in proportional relation to the rotating number of the motor, avoiding an excessive or insufficient supply of a lubricating oil and realizing a proper supply of the lubricating oil even in high-speed rotation of the motor. Thus the compressor is highly reliable. Further, a screening plate is provided in the suction space of a compressor, so that the lubricating oil in the coolant or cooling medium can be effectively separated from the coolant, resulting in enhancement of collecting efficiency of the lubricating oil. Moreover, the screening plate is useful to prevent a hermetic terminal from being cooled by the returning coolant. Otherwise, dew condensation would occur on the hermetic terminal, and leakage or shortcircuiting would be caused, a vital obstacle to the safety of the compressor.

22 Claims, 5 Drawing Sheets

SCROLL COMPRESSOR WITH INTERMITTENT OIL SUPPLY PASSAGE

BACKGROUND OF THE INVENTION

1. Field of the Invention

The present invention generally relates to a scroll compressor for use in a refrigerating system in, for example, an air conditioning apparatus or a refrigerator, and more particularly, to a so-called low-pressure scroll compressor in which the suction pressure acts on a tub of lubricating oil.

2. Description of the Prior Art

One example of a conventional compressor is illustrated in FIG. 8.

In the compressor of FIG. 8, there are provided a stator 102 and a rotor 103 of a motor inside a closed casing 101. A scroll compressor system 104 is placed above the motor and its driving shaft, namely, a crank shaft 105 is coupled to the rotor 103.

A hermetic terminal 106 for the motor is provided at the side surface of the closed casing 101. A cooling medium or coolant entering from a suction pipe 107 into the closed casing 101 is partly sucked into the compressor system 104 from a suction port 108 as indicated by a large arrow, and partly scattered in the closed casing 101 by the flow of the air inside the closed casing 101. A fixed scroll component 109 has a spiral vane 110 and a mirror plate 111. A turning orbiting scroll component 112 has a spiral vane 113 and a mirror plate 114. The spiral vanes 110 and 113 are brought in mesh with each other, so that the vanes 110 and 113 constitute a compression chamber 115 which, moving towards the center of the compressor from the outer periphery thereof to reduce its capacity, carries out compression action. The coolant coming out of an exhaust port 116 which is provided at the center of the fixed scroll component 109 is guided to an exhaust pipe 118 of the compressor from an exhaust space 117.

The pressure in the compression chamber 115 presses the turning scroll component 112 against the opposite side of the compression chamber 115, the force of which is supported by a thrust bearing 120 fixed to a bearing member 119 which supports first and second main shafts 121 and 122 of the crank shaft 105.

The first main shaft 121 has a turning driving bearing 123 provided inside thereof eccentrically from the center of the shaft. A turning driving shaft 124 fitted in the turning bearing 123 is provided in the mirror plate 114 of the turning scroll component 112.

In the outer periphery of the thrust bearing 120, a rotation restricting element 127 having a pair of keys 126 on the opposite surfaces of a circular ring member 125 is provided so as to restrict the rotation of the turning scroll component 112.

A lubricating oil tub 128 is placed in the lower part of the closed casing 101. The lubricating oil in the tub 128 is supplied from an oil feed port 129 of the crank shaft 105 to every sliding portion of the compressor by an oil feed pump 130.

In the conventional compressor having the above-described structure, the lubrication by the lubricating oil in each sliding portion of the compressor will be set up as described hereinbelow.

Upon rotation of the electric motor, the lubricating oil in the tub 128 is, as indicated by a small arrow, brought into the oil feed port 129 of the crank shaft 105 by the action of the oil feed pump 130. The lubricating oil is, passing through an oil passage 131 in the crank shaft 105 and lubricating the turning driving bearing 123 of the compression system 104 and each sliding portion in the inner periphery of the thrust bearing 120 and in the outer periphery of the first main shaft 121, then supplied to a secondary bearing 132 provided in the lower part of the bearing member 119. Thereafter, the lubricating oil is discharged to the upper part of the motor to be returned to the tub 128 through a notched part 133 formed in the outer edge of the stator 102.

However, the conventional low-pressure scroll compressor in which the suction pressure acts inside the closed casing 101 as described above has such demerits as follow.

In other words, the inside of the closed casing 101 is divided into the suction pressure space and the exhaust pressure space by the compression system 104, and therefore, the lubricating oil which is mixed with the coolant and is discharged out of the compression system 104 is never returned into the compression system until the lubricating oil moves all around the refrigerating cycle.

Meanwhile, the closed casing 101 has many sliding portions thereinside such as the compression system 104, etc., thus requring much lubrication oil.

Consequently, in the conventional low-pressure scroll compressor in which the lubricating oil is returned to the compression system after being circulated all around in the refrigeration cycle, it is disadvantageous that:

(1) if the amount of the lubricating oil to be discharged in mixture with the coolant is increased, an oil film is generated in the heat exchanger (regenerator) of the refrigerating cycle, thereby lowering the regeneration efficiency of the refrigerating cycle, and (2) if the amount of the lubricating oil to be supplied to the compressor system 104 is reduced contrary to the above case (1), the compressor system 104 may be overheated, or the oil film may be insufficiently produced to lower the sealing efficiency, resulting in total decline of the efficiency of the compressor itself.

It has been widely practiced in recent years to control the capacity of the compressor that the rotating number of the compressor (motor) is increased or decreased depending on required efficiency, that is, a so-called inverter driving of the compressor has been widely known.

However, if the inverter driving is applied to the conventional low-pressure scroll compressor, the disadvantages (1) and (2) described earlier would be of much more concern.

In other words, although the amount of the lubricating oil necessary for the compressor system 104 is arranged to be increased in proportion to the increase of the rotating number of the motor, sufficient lubricating oil for high-speed rotation of the compressor can not be obtained in such construction because only the lubricating oil leaking from the portions sliding with the thrust bearing 120 is led to the compressor system 104.

For solving the above problem, it may be possible, for example, that the ring member 125 is made thinner or a groove or the like is formed in a part of the ring member 125, so that the lubricating oil is partly positively guided into the compression system 104. In spite of this arrangement, however, sufficient amount of the lubricating oil can not be secured for the entire range of operation from the low-speed rotation to the high-speed rotation of the motor.

The above fact could be confirmed by an experiment, the reason for which will be as follows.

Namely, since the flow of the air is given rise to in the closed casing 101 in the rotational direction of the motor, the coolant returning from the suction pipe 107 rides on the flow of the air and is sucked in from the suction port 108 to be compressed in the compressor system 104 and exhausted. At this time, the lubricating oil included in the coolant is also sucked in from the suction portion 108 without being separated sufficiently from the coolant in the suction space, then repeatedly going around the refrigerating cycle.

In the above case, when the rotating number of the motor is further increased, the amount of the lubricating oil drawn up by the oil feed pump 130 is increased too, and accordingly, the amount of the lubricating oil to be supplied becomes larger than the amount of the lubricating oil collected from the returning coolant, resulting in lack of the oil amount in the tub 128. In consequence, such inconveniences are brought about that the sliding portions may be overheated, or the regenerating efficiency may be lowered because of the increase of the lubricating oil circulating in the circuit of the coolant (not shown) outside the closed casing 101.

FIG. 7 is a characteristic diagram showing the relationship between the rotating number N (rpm) and the exhaust amount of the lubricating oil V (cc/min.) in the low-pressure scroll compressor in which the rotating number of the motor is controlled.

The foregoing description is represented by the characteristic diagram shown by a broken line.

Moreover, in the conventional low-pressure scroll compressor, the flow of the air is given rise to in the same direction as the rotating direction of the motor in the space at the side of the suction port 108, and therefore the lubricating oil included in the coolant is easier to be sucked in from the suction port 108, and is difficult to be collected. It becomes more difficult to collect the lubricating oil included in the coolant as the rotating number of the motor is increased, as has been described earlier.

Further, since the closed casing 101 is filled with the low-temperature, low-pressure coolant in the conventional low-pressure scroll compressor, the closed casing 101 is cooled, easily causing the condensation of dew in the outer periphery of the closed casing 101.

Although the dew condensation described above is able to be eliminated if the closed casing 101 is covered with an adiabatic material or in a similar manner, the hermetic terminal 106, which is a power take-in port for the motor, is hard to shut off from the heat. Particularly, since the hermetic terminal 106 is applied with electric pressure, it is considerably important to prevent leakage or short-circuiting resulting from the dew condensation.

At the high-speed rotation of the motor, the rotating number of the crank shaft 105 becomes increased, and accordingly the supply efficiency of the lubricating oil becomes large because of the increase of the centrifugal force. Therefore, the lubricating oil is discharged more into the space between the bearing member 119 and the motor. Moreover, as the speed of the coolant gas sucked in from the suction port 108 is also increased, a large amount of the lubricating oil is sucked in from the suction port 108 outside the closed casing 101 through the compressor system 104 and the exhaust pipe 118, to be returned from the suction pipe 107 again. Accordingly, the lubricating oil returning from the suction pipe 107 is mixed with the lubricating oil discharged out of the upper part of the rotor 103 after lubricating and cooling each of the bearing members and the sliding portions, and is sucked into the suction port 108. Thus, the discharging amount of the oil is increased more and more at the high-speed rotation of the motor as clearly seen from the diagram shown by the broken line in FIG. 7, and finally the lubricating oil in the tub 128 is exhausted.

Therefore, it becomes necessary, particularly in the low-pressure scroll compressor which is adapted to control the rotating number of the motor, that the amount of the lubricating oil to be supplied to the compressor system 104 is controlled within a proper range regardless of the increase or decrease of the rotating number of the motor, and simultaneously, the lubricating oil is securely collected in the tub 128.

SUMMARY OF THE INVENTION

An essential object of the present invention is to provide an improved low-pressure scroll compressor which is arranged to supply a proper amount of the lubricating oil to the compressor components, thereby to improve the reliability of the compressor.

Another object of the present invention is to provide an improved low-pressure scroll compressor of the type referred to above, in which the proper amount of the lubricating oil is arranged to be supplied to the compressor components by utilizing the mechanism of the compressor components, thereby to simplify the structure of the compressor.

A further object of the present invention is to provide an improved low-pressure scroll compressor of the type referred to above which is provided with a screening plate in the suction space of a closed casing and in the middle of the flow of the coolant running in the rotating direction of the motor so as to interrupt the flow of the coolant, thereby enhancing the separating efficiency of the lubricating oil from the coolant and securing the amount of the lubricating oil in the closed casing.

Another object of the present invention is to provide an improved low-pressure scroll compressor of the type referred to above which is arranged to prevent, by the screening plate, the liquid component of the returning coolant from being scattered on a hermetic terminal and also to prevent the dew condensation resulting from cooling of the hermetic terminal.

A still further object of the present invention is to provide an improved low-pressure scroll compressor of the type referred to above in which the screening plate is provided on a bearing member of a compressor unit, thereby simplifying the assembling operation of the compressor.

A yet further object of the present invention is to provide an improved low-pressure scroll compressor of the type referred to above in which the lubricating oil accumulated in the bearing member which supports a crank shaft is arranged to be scattered over the side of the hermetic terminal from an oil nozzle, so that the temperature in the vicinity of the hermetic terminal is raised by the scattered oil, thereby preventing dew condensation at the hermetic terminal.

Still another object of the present invention is to provide an improved low-pressure scroll compressor of the type referred to above in which the oil nozzle is formed at a position displaced from the suction port with respect to the rotating direction of the motor, so that the lubricating oil jetted out of the oil nozzle is able to flow to the tub, without being influenced by the suction pressure towards the suction port, thereby controlling the amount of the lubricating oil discharged to the refrigerating cycle, resulting in improvement of the reliability of the compressor.

In accomplishing the above-described objects, according to the present invention, there is provided, in a scroll compressor including a closed casing, a scroll compressor unit provided inside the closed casing, an electric motor provided in the closed casing for driving the compressor unit through a crank shaft consisting of a main shaft portion and a crank shaft portion, and an oil tub provided in the lowest part of the closed casing for storing lubricating oil therein. The compressor unit divides the interior of the closed casing into an exhaust space where the exhaust pressure of the compressor unit works and a suction space into which is flowed the returning cooling medium of the refrigerating cycle and which is communicated to a suction port of the compressor unit. The compressor unit comprises a partition plate for dividing the interior of said closed casing into the exhaust space and the suction space, a fixed scroll member fixed to the partition plate, or formed into one unit with the partition plate, and at the same time provided with a mirror plate and a spiral vane on one surface of the mirror plate, a turning or orbiting scroll member provided with a mirror plate and a spiral vane on one surface of the mirror plate, so that the spiral vane is meshed with the spiral vane of the fixed scroll member, thereby forming many closed compressed chambers having different capacities, the crank shaft coupled to a rotor of the electric motor for turning the turning scroll member, a bearing member for supporting the main shaft portion of the crank shaft, a thrust bearing in contact with the surface opposite to the vane in the mirror plate of the turning scroll member and supported by a bearing surface of the bearing member, so as to support the face of the compressed pressure on the turning scroll member in the direction of the rotating shaft, and a rotation restriction mechanism for restricting the rotation of the turning scroll member; the rotation restriction mechanism is constructed by a ring member in the outer periphery of the thrust bearing, with a pair of keys or key ways provided on one surface thereof in a manner to be separated 180° from each other, and another pair of keys or key ways provided on the other surface thereof in a manner to be separated 180° from each other and 90° from the above pair of keys or key ways, and a pair of keys or key ways provided in the rear surface of the mirror plate of the turning scroll member and in the bearing surface of the bearing member, to be reciprocally movably engaged with the keys or key ways. An expansion space is formed by the inner peripheral surface of the ring member, the rear surface of the mirror plate of the turning scroll member, the bearing surface of the bearing member and the outer peripheral surface of the thrust bearing, sandwiching the crank shaft portion of the crank shaft, and is alternately expanded and contracted in accordance with the reciprocal movement of the ring member. A main oil passage is formed in the crank shaft in a manner to pass oil therethrough from the lower end of the main shaft portion to the front end of the crank shaft portion. A thrust oil groove is formed in the form of many grooves on the upper bearing surface of said thrust bearing. An oil pump is provided at the lower end of the main shaft portion for drawing up the lubricating oil in the oil tub to the main oil passage. An oil supply inside route is communicated from the end of the crank shaft portion to the thrust oil groove of the thrust bearing, but not communicated to the expansion space, and an intermittent oil supply passage communicates the space outside the ring member with the space outside vanes of the fixed scroll member and the turning scroll member (at the side of the suction port), which is, in accordance with the turning movement of the scroll turning member, communicated to the thrust oil groove, in the process mainly while said expansion space is contracted, and is communicated to the expansion space mainly while the expansion space is expanded, in the rear surface of the mirror plate of said turning scroll member.

BRIEF DESCRIPTION OF THE DRAWINGS

The above and other objects and features of the present invention will become clear from the following description taken in conjunction with the preferred embodiments thereof with reference to the accompanying drawings, in which.

DETAILED DESCRIPTION OF THE INVENTION

Figure 1:
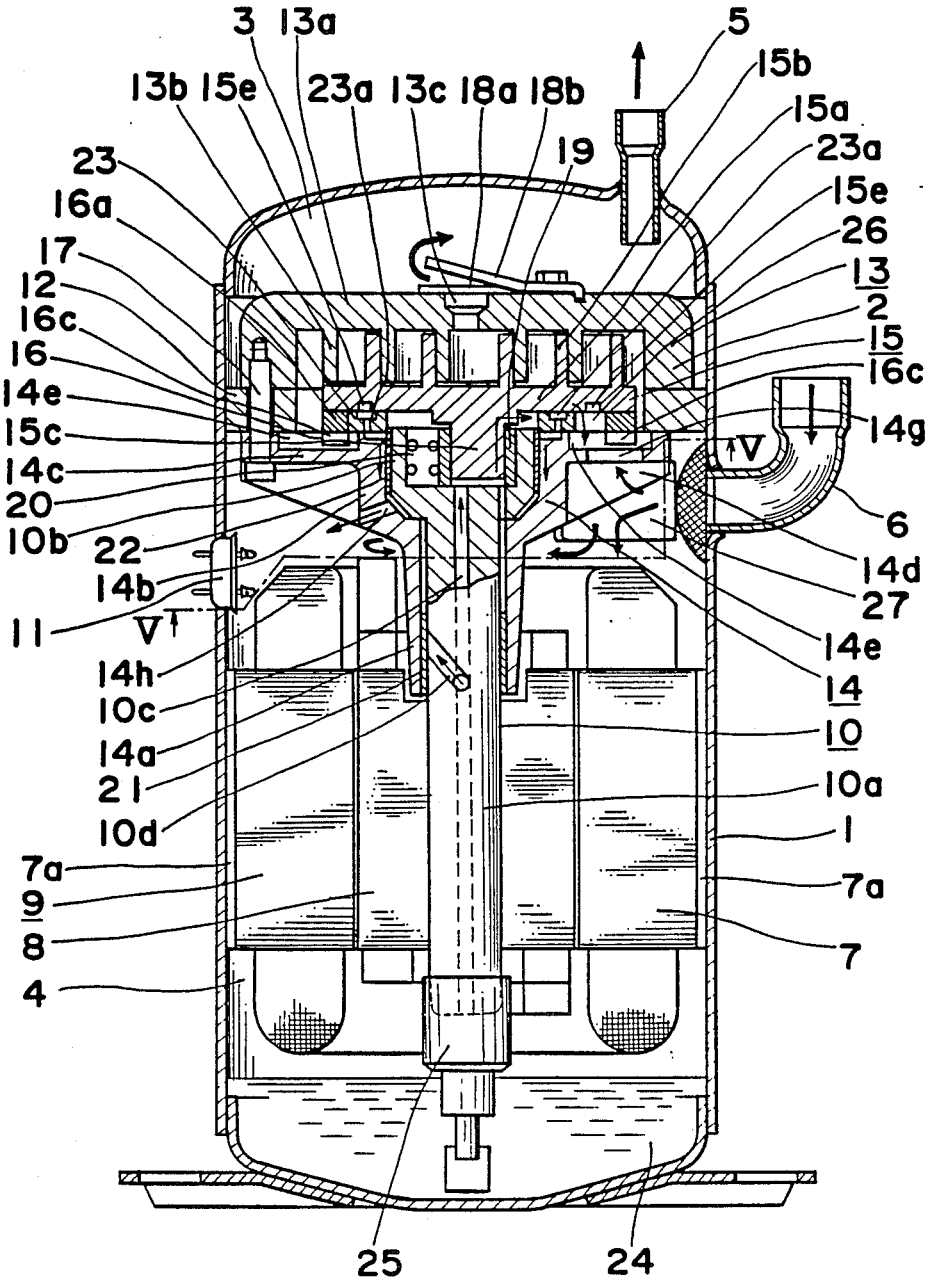
FIG. 1 is a cross sectional view of a low-pressure scroll compressor according to the present invention.

Before the description of the present invention proceeds, it is to be noted that like parts are designated by like reference numerals throughout the accompanying drawings.

Referring to the compressor of the present invention in FIG. 1, the interior of a closed casing 1 is divided into two spaces, namely, a space 3 at the exhaust side and a space 4 at the suction side by a compressor unit 2. An exhaust pipe 5 is opened in the exhaust side space 3 of the closed casing 1, and a suction pipe 6 is opened in the suction side space 4 through a wire netting 6*a* for prevention of dust. There is further provided inside the suction side space 4, an electric motor 9 which is pressed in the closed casing 1. The motor 9 is comprised of a stator 7 and a rotor 8, the power of which is transmitted to the compressor unit 2 through a crank shaft 10. Moreover, electric power for the motor 9 is taken in from a hermetic terminal 11 (which will be referred to as a terminal hereinbelow) provided at the side wall of the closed casing 1. The hermetic terminal 11 is positioned symmetrically to the suction pipe 6 with respect to the crank shaft 10.

Figure 2:
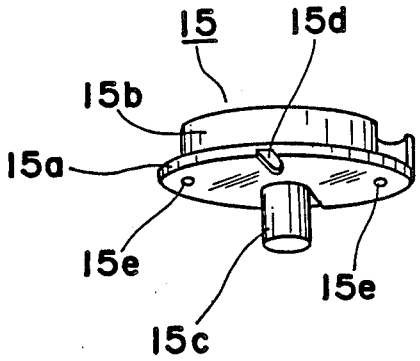
FIG. 2 is a perspective view of a turning scroll member of the compressor of FIG. 1.

The structure of the above-described compressor unit 2 will be described hereinbelow with reference to FIGS. 1, 2 and 3.

Broadly speaking, the compressor unit 2 is constituted by a partition plate 12 which is provided so as to divide the interior of the closed casing 1 into the exhaust space 3 and the suction space 4, a fixed scroll member 13 sandwiching the partition plate 12, a bearing member 14 supporting the crank shaft 10, a turning or orbiting scroll member 15 which compresses the coolant in cooperation with the fixed scroll member 13, and a rotation restriction mechanism 16. The partition plate 12, the fixed scroll member 13 and the bearing member 14 are tightly secured to each other by many bolts 17. It is to be noted here that the partition plate 12 and the fixed scroll member 13 may be formed in one unit upon necessity.

Each of the above components of the compressor will be described in more detail.

The fixed scroll member 13 has a mirror plate **13*a*, and a spiral vane 13*b* provided in the mirror plate 13*a*. An exhaust port 13*c* is formed approximately at the center of the mirror plate 13*a*, and is opened to the exhaust space 3. The exhaust port 13*c* is provided with an exhaust valve 18*a* which normally blocks the exhaust port 13*c* and a valve guard 18*b* which controls the degree of opening of the exhaust valve 18*a***.

The turning scroll member 15 includes a mirror plate **15*a*, a spiral vane 15*b* provided all over the mirror plate 15*a* and a turning driving shaft 15*c* provided at the opposite side of the mirror plate 15*a*. The turning scroll member 15 is so assembled that many rooms are formed by the vanes 15*b* and 13*b*, the respective capacity of which is sequentially reduced in accordance with the meshing of the vanes 15*b* and 13*b***.

The crank shaft 10 is comprised of a straight main shaft portion **10*a* and a crank shaft portion 10*b* at the end of the main shaft portion 10*a*. The hollow crank shaft portion 10*b* has a diameter larger than the main shaft portion 10*a*. In the hollow of the crank shaft portion 10*b*, there are placed a turning bearing 19 which turnably supports the turning driving shaft 15*c* of the turning scroll member 15, and at the same time, which is inserted reciprocally movably in the hollow, and a spring 20 which normally presses the turning bearing 19 to one side, the detail of which is seen from FIG. 4**.

The bearing member 14 consists of a main shaft supporting part **14*a* for supporting the main shaft portion 10*a* of the crank shaft 10 through a lower bearing 21, a crank shaft supporting part 14*b* for supporting the crank shaft portion 10*b* of the crank shaft 10 through an upper bearing 22, a thrust bearing part 14*c* for supporting a thrust bearing 23 which will be described later, and reinforcing ribs 14*d* which protrude in a radial direction from the crank shaft supporting part 14*b* so as to reinforce the thrust bearing part 14*c***.

Figure 3:
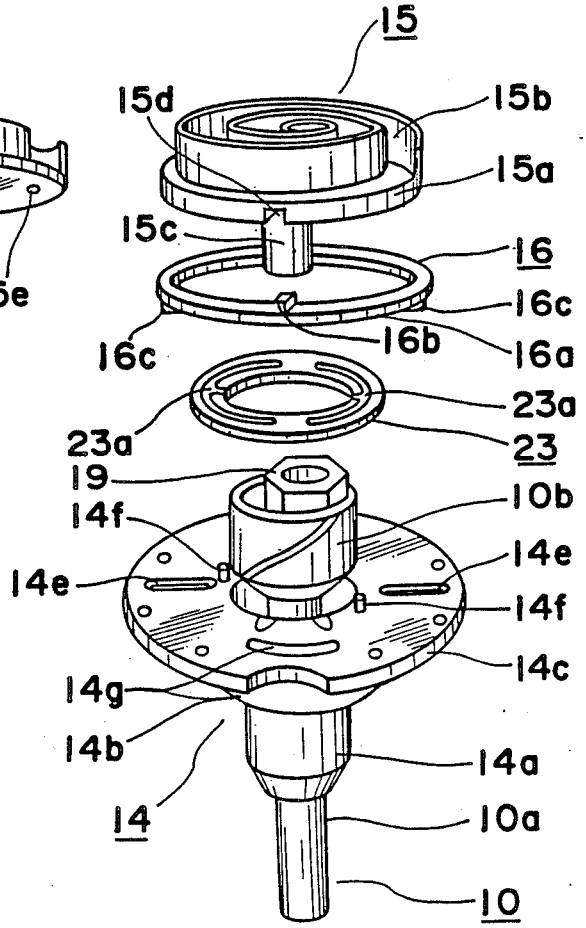
FIG. 3 is an exploded perspective view of a compressor unit of the compressor of FIG. 1.

As is clearly indicated in FIG. 3, the rotation restriction mechanism 16 has a ring member **16*a* which is formed by curved portions and straight portions, a pair of keys 16*b* mounted on the upper surface of the straight portions of the ring member 16*a* in a manner to confront each other, and a pair of keys 16*c* provided on the under surface of the curved portions of the ring member 16*a* in a manner to confront each other. The key 16*b* is reciprocally fitted in a key groove 15*d* formed in the reverse face of the mirror plate 15*a* of the turning scroll member 15. On the other hand, the key 16*c* is designed to be reciprocally fitted in a key groove 14*e* formed in the bearing surface of the thrust bearing part 14*c* of the bearing member 14. Moreover, each pair of the keys 16*b* and 16*c* is respectively positioned in the 180° opposite direction, and the lines connecting the pairs of the keys 16*b* and 16*c*** intersect at 90°.

Figure 4:
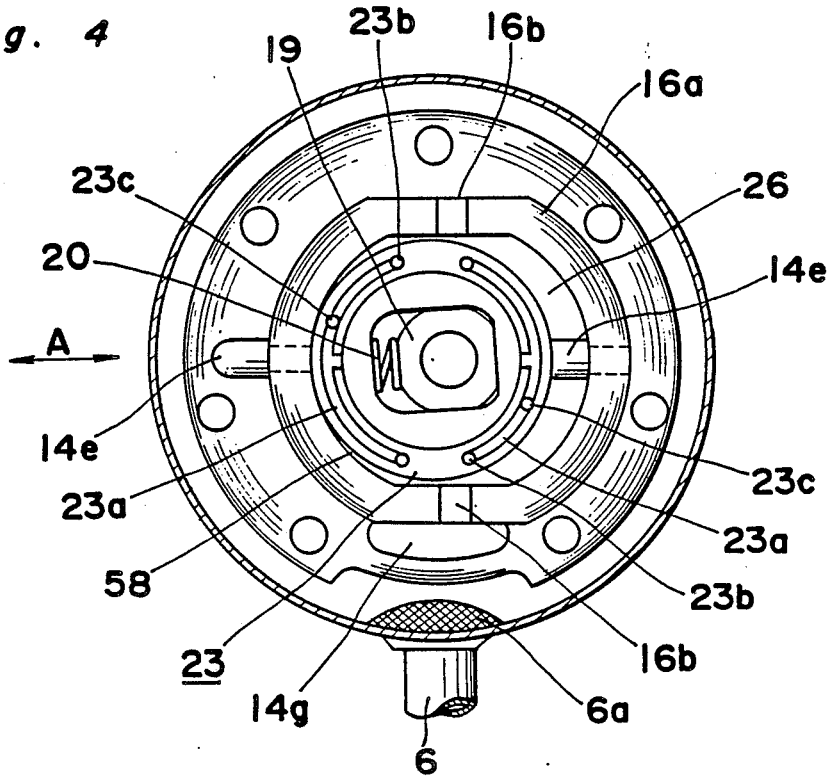
FIG. 4 is a plan view of the compressor of FIG. 1, seen from above, with a fixed scroll member, a screening plate and a turning scroll member removed.

By the thrust bearing 23, the thrust bearing part **14*c* is prevented from being brought in contact with the mirror plate 15*a* of the turning scroll member 15, and also the turning scroll member 15 is prevented from being separated from the fixed scroll member 13. As shown in FIG. 4, the thrust bearing 23 has a pair of thrust oil passages 23*a* formed in the surface in contact with the mirror plate 15*a* in a symmetrical manner. At the opposite ends of the oil passage 23*a*, there are formed through-holes 23*b* each passing through to the rear surface of the oil passage. Further, a hole 23*c* is formed in the thrust bearing 23, into which is fitted a fixed pin 14*f* provided at the thrust bearing part 14*c* of the bearing member 14, so that the thrust bearing 23** is fixedly secured not to be rotated.

Next, how the lubricating oil is supplied to the bearing member 14 and the compressor unit 2 will be described hereinbelow.

A lubricating oil tub 24 is placed at the bottom of the closed casing 1.

An oil feed pump 25 is provided in the lower part of the crank shaft 10 so as to draw up the lubricating oil in the tub 24. A main oil supply passage **10*c* is passed through the center of the crank shaft 10, one end of which is communicated to the oil feed pump 25 and the other end of which is opened at the bottom of the hollow of the crank shaft portion 10*b*. A divergent oil passage 10*d* is formed halfway of the main oil passage 10*c* for lubrication of the lower bearing 21**.

The main oil passage **10*c* is communicated from the upper end thereof to the space surrounded by the inner periphery of the thrust bearing 23 through the hollow portion of the crank shaft portion 10*b* including the turning bearing 19**.

The ring member **16*a*, the reverse surface of the mirror plate 15*a* of the turning scroll member 15 and the thrust bearing part 14*c* of the bearing member 14 form an expansion space 26 in the outer periphery of the thrust bearing 23. The capacity of the expansion space 26 at one side of the thrust bearing 23 is reduced, while the capacity of the expansion space 26 at the other side of the thrust bearing 23 is increased, as the ring member 16*a* is reciprocally moved in accordance with the rotation of the turning scroll member 15. The decrease and increase of the capacity of the expansion space 26** is repeated alternately hereinafter.

A pair of oil recesses **15*e* are formed in the reverse surface of the mirror plate 15*a* of the turning scroll member 15 symmetrically to each other with respect to the turning driving shaft 15*c*. It is so arranged that when the capacity of the expansion space 26 at one side is reduced to the minimum, one of the oil recesses 15*e* is overlapped with one of the thrust oil passages 23*a*, with the other oil recess 15*e* being opened over the expansion space 26 at the other side, the capacity of which is increased. The oil recess 15*e* is communicated alternately to the thrust oil passage 23*a* and the expansion space 26**.

A suction port **14*g* of the compressor unit 2 is formed in the thrust bearing part 14*c* of the bearing member 14 at a position approximately opposite to the suction pipe 6**.

Moreover, there is an oil nozzle **14*h* of the crank shaft supporting part 14*b* of the bearing member 14 below the upper bearing 22. The oil nozzle 14*h* is opened at an opposed position to the terminal 11** so as to gush out the lubricating oil which has lubricated every sliding portion.

Figure 5:
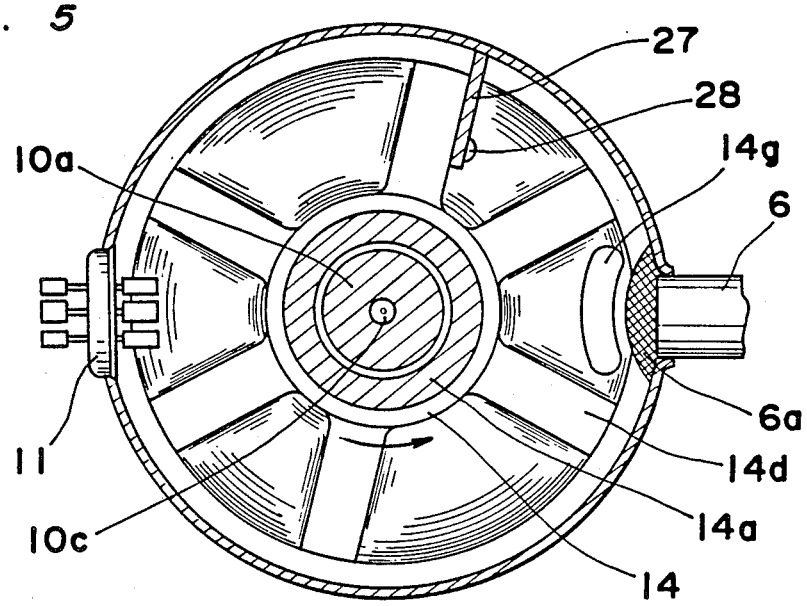
FIG. 5 is a cross sectional view taken along the line V—V of FIG. 1.
Figure 6:
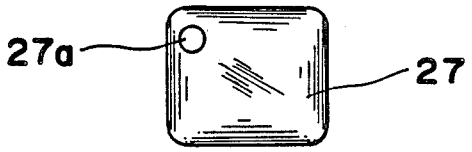
FIG. 6 is a front elevational view of a screening plate.

One of the reinforcing ribs 14*d* of the bearing member 14 has a screening plate 27 in such a shape as shown in FIG. 6. More specifically, the screening plate 27 placed behind the suction port 14*g* in the rotating direction of the motor as shown by an arrow in FIG. 5 is fixed to one of the reinforcing ribs 14*d* by a bolt 28 passing through the hole 27*a*.

The operation of the low-pressure scroll compressor having the above-described construction will be described hereinafter. Since the refrigerating cycle connected to the exhaust pipe 5 and the suction pipe 6 of the compressor is already well known, the description therefor will be abbreviated here.

When the motor 9 is rotated, the turning scroll member 15 is rotated. In accordance with this rotation of the turning scroll member 15, the coolant in many spaces formed by the vane 13*b* of the fixed scroll member 13 and the spiral vane 15*b* of the turning scroll member 15 is gradually compressed by a well-known principle because of the reduction in the capacity of the spaces, and at the same time, while the coolant is compressed, it is moved to the center of the compressor, pushing up the exhaust valve 18*a* through the exhaust port 13*c*, and finally it is discharged into the exhaust space 3. Thereafter, the coolant is circulated in the refrigerating cycle starting from the exhaust pipe 5 to be returned to the suction space 4 through the suction pipe 6. The coolant returned into the suction space 4 is sucked in from the suction port 14*g* to be compressed again. Thereafter, the above-described sequence of operations is repeated.

Meanwhile, the lubricating oil in the tub 24 is, as indicated by the small arrow, drawn up by the oil feed pump 25 to be supplied to the lower end of the turning bearing 19 through the main oil supply passage 10*c*. It is to be noted here that the lubricating oil is partly guided into the divergent oil passage 10*d*, thereby lubricating the lower bearing 21. After the lubricating oil lubricates the sliding portions of the turning bearing 19, it is collected in the space in the inner periphery of the thrust bearing 23. Then, the lubricating oil runs through the oil passage 23*a* on the surface of the thrust bearing 23, thereby to lubricate the surface of the thrust bearing 23. The lubricating oil then flows out to the reverse surface of the thrust bearing 23, running through the throughhole 23*b* from the oil passage 23*a*, and lubricates the upper bearing 22 from above to below. Then, the lubricating oil is spouted out into the suction space 4 from the oil nozzle 14*h* formed in the crank bearing part 14*b*.

In the meantime, the oil recess 15*e* provided in the reverse surface of the mirror plate 15*a* of the turning scroll member 15 is overlapped, while rotating, with the thrust oil passage 23*a* of the thrust bearing 23 at a given position. Upon further rotation, the overlapping of the oil recess 15*e* with the thrust bearing 23 is released. The foregoing operation is repeated, that is, the overlapping and releasing of the overlapping is repeated. During the repeated operation, the lubricating oil flowing in the thrust oil passage 23*a* is intermittently drawn out by the oil recess 15*e* and scattered over the thrust bearing part 14*c* of the bearing member 14.

The lubricating oil scattered over the thrust bearing part 14*c* rides on the flow of the coolant sucked into the compressor unit 2 from the suction port 14*g*, and accordingly it is sucked into the compressor unit 2. The lubricating oil sucked into the compressor unit 2 performs lubrication of each sliding portion and sealing of crevices of the sliding portions when the coolant is compressed by the turning scroll member 15 and the fixed scroll member 13.

Accordingly, the lubricating oil can be intermittently supplied to the compressor unit 2 by the oil recess 15*e*. Moreover, since the supply amount of the lubricating oil for one time is at most the capacity of the oil recess 15*e*, the supply amount is never excessive. Even when the rotating number of the compressor is increased, the supply amount of the lubricating oil per one rotation of the compressor is almost constant. Therefore, the lubricating oil is not supplied extraordinarily in excess even when the rotating number of the compressor is increased.

Figure 7:
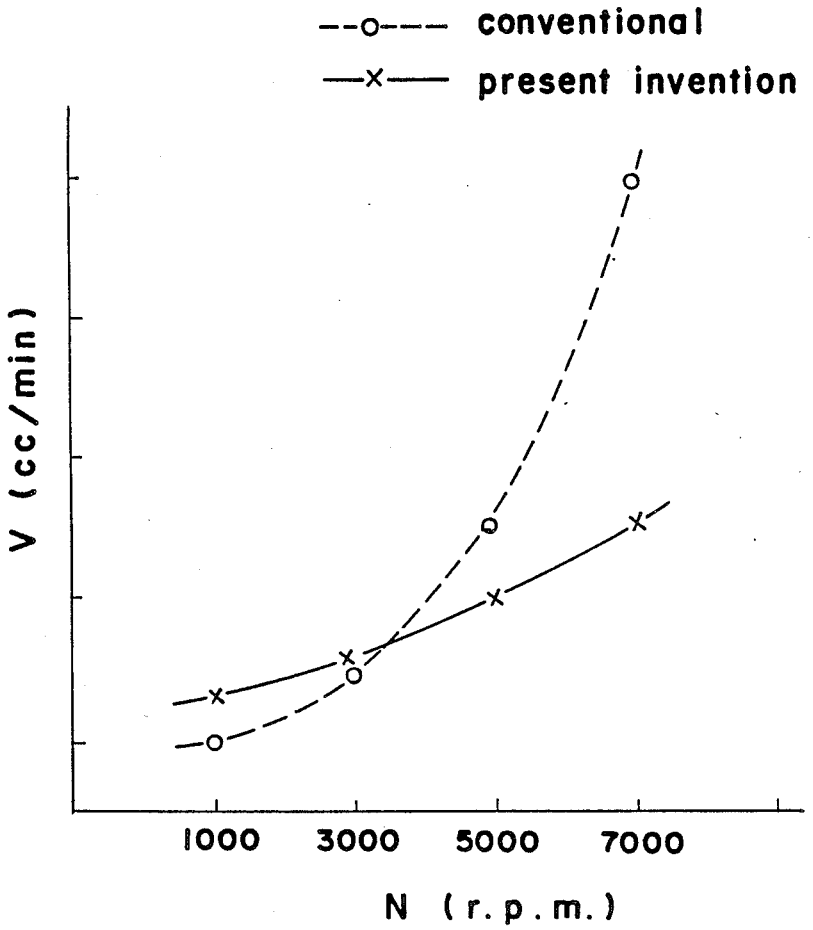
FIG. 7 is a characteristic diagram showing the relationship between the rotating number of the motor and the discharging amount of the lubricating oil.
Figure 8:
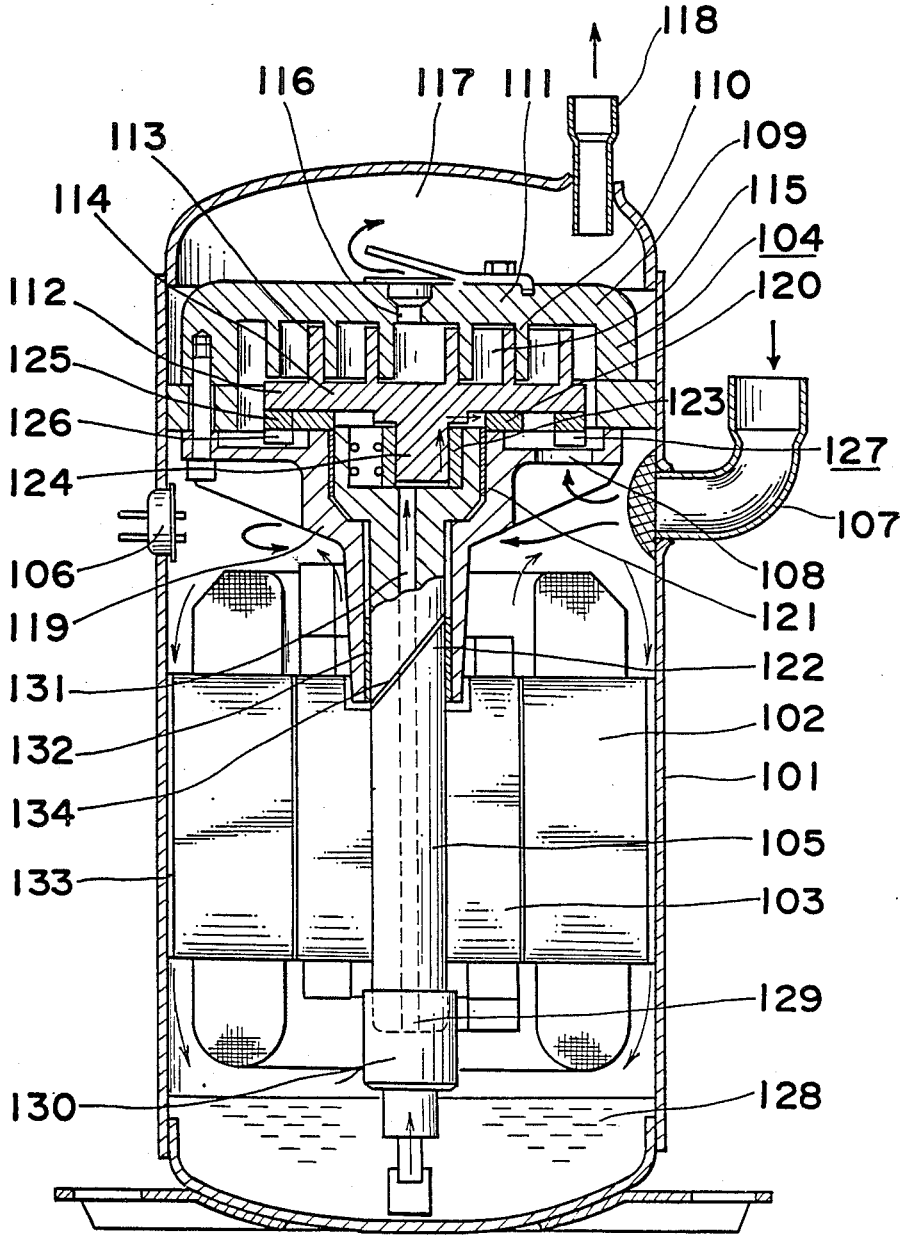
Fig. 8 PRIOR ART
FIG. 8 is a cross sectional view of a conventional low-pressure scroll compressor (already referred to).

The supply condition of the lubricating oil as described above is indicated in the characteristic diagram of FIG. 7 shown by a solid line, and it is made clear by the experiment that the supply of the lubricating oil is not carried out in an excessive amount even in the high-speed range of the compressor.

Since the lubricating oil spouted out from the oil nozzle 14*h* of the bearing member 14 is heated by friction heat among the sliding portions, the temperature in the vicinity of the terminal 11 is heated by the atmospheric temperature thereabout, and it is never cooled even when the sucked coolant at low temperatures is full in the suction space 4. No dew condensation is therefore observed in the terminal 11, thus not only preventing leakage which would result from the dew condensation, but securing high safety of the compressor.

Additionally, the oil nozzle 14*h* is opened at a position separated approximately 180° from the suction port 14*g*, and therefore such inconvenience can be solved that the gushed lubricating oil from the nozzle 14*h* rides on the air flow generated in the rotating direction of the motor 9, and is sucked into the suction port 14*g*.

The position of the oil nozzle 14*h* is not restricted to that separated about 180° from the suction port 14*g* to be opposite to the suction port 14*g* in order to prevent the lubricating oil jetted out from the oil nozzle 14*h* from being sucked into the suction port 14*g*. In other words, the oil nozzle 14*h* may be placed anywhere if it misses the suction port 14*g* more or less, that is, it is displaced more or less from the suction port 14*g* in the rotating direction of the compressor.

The lubricating oil gushed out from the oil nozzle 14*h* is, after raising the atmospheric temperature of the terminal 11, collected in the tub 24 through a down oil passage 7*a* formed in the outer periphery of the stator 7.

In the suction space 4 of the closed casing 1 is produced the flow of the air by the rotation of the motor 9 in the rotating direction. Since the flow of the air is interrupted by the screening plate 27 to be weakened, the direction of the lubricating oil when it is gushed out of the oil nozzle 14*h* is not obstructed.

The flow of the coolant running out of the suction pipe 6 will be described now.

As indicated by the large arrow in FIG. 1, the coolant flowing out of the suction pipe 6 partly rides on the flow of the air in the rotating direction and collides against the screening plate 27. It is needless to say that only a small part of the coolant rides on the flow of the air, without colliding against the screening plate 27, and turns around in the suction space 4.

As described above, the coolant colliding against the screening plate 27 is detached from the lubricating oil included in the coolant because of the collision force, then riding on the flow of the air and turning around in the suction space 4, to be sucked in from the suction port 14*g*.

On the other hand, the lubricating oil separated from the coolant is turned into drops of oil which in turn drop to gather in the tub 24 through the down oil passage 7*a* of the stator 7.

The screening plate 27 serves not only to separate the lubricating oil from the coolant, but to avoid the unfavorable influences brought about in the case where the returning coolant is a liquid coolant.

Specifically, without the screening plate 27, the liquid coolant would ride on the flow of the air to be scattered over the terminal 11, thereby cooling the terminal 11, resulting in the condensation of dew upon the terminal 11.

Actually, since the screening plate 27 is provided in the compressor of the present invention, the liquid coolant is prevented by the screening plate from turning around in the suction space 4 to be scattered on the terminal 11, thus avoiding the above-described unfavorable influences.

Thus, according to the compressor of the present invention having the above-described construction, the lubricating oil is supplied in the manner as confirmed by the experiment and indicated by the solid line in FIG. 7, and the excessive supply of the lubricating oil can be prevented.

As has been described hereinabove, the compressor of the present invention has the following advantages.

(1) Because of the arrangement that the lubricating oil is intermittently supplied to the compressor unit 2, an excessive oil supply or insufficient oil supply can be avoided, and the proper supply of the oil is secured.

(2) The intermittent supply of the lubricating oil is done in proportion to the rotating number of the compressor (motor 9), and therefore, secure and proper supply of the oil is facilitated even in such a compressor that makes a wide-range control of the rotating number of the motor, thus improving the reliability of the compressor.

(3) The above intermittent supply of the lubricating oil is done by utilizing the movement of the turning scroll member 15 in the compressor unit 2, thus rendering simple the structure of the compressor. Therefore, the compressor of the present invention is easily realized and high in reliability.

(4) Since the screening plate 27 is placed in the suction space 4, the lubricating oil included in the coolant can be separated from the coolant with improved efficiency. The collecting efficiency of the lubricating oil can be improved.

(5) By the screening plate 27, the hermetic terminal 11 can be prevented from being cooled when the liquid coolant flows in, and therefore, the dew condensation upon the terminal 11 resulting from cooling of the terminal 11 can be restricted. At the same time, dangerous leakage caused by the dew condensation can also be restricted, thereby improving the safety of the compressor.

(6) Since the screening plate 27 is designed to be provided with the bearing member 14, the screening plate 27 can be provided in the bearing member 14 in advance when the compressor unit 2 is assembled. Thus, the assembling efficiency becomes enhanced.

(7) The lubricating oil at high temperatures is arranged to be gushed out of the oil nozzle 14*h* formed in the crank shaft supporting part 14*b* to the side of the hermetic terminal 11. Therefore, the hermetic terminal 11 is warmed and prevented from being cooled by the low-temperature, low-pressure coolant. Thus, it can be more effectively prevented that the dew is condensed upon the terminal 11, thereby to improve the safety of the compressor.

(8) Since the oil nozzle 14*h* misses the position of the suction port 14*g* in the rotating direction of the compressor (motor 9), in other words, the oil nozzle 14*h* is displaced from the suction port 14*g* in the rotating direction of the compressor, the gushed lubricating oil is never affected by the suction pressure at the suction port 14*g*. Accordingly, the hermetic terminal 11 can be warmed with more certainty, and the lubricating oil can be securely guided to the tub 24, resulting in enhancement of the reliability of and the safety of the compressor.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A scroll compressor for compressing a cooling medium in a refrigerating cycle, comprising:

a compressor casing;

a scroll compressor unit provided in said compressor casing;

drive means for driving said scroll compressor unit to compress said cooling medium; and an oil sump in said casing;

said scroll compressor unit comprising:

a fixed scroll member fixed inside said casing, said fixed scroll member having a fixed mirror plate and a fixed spiral vane on one surface of said fixed mirror plate;

an orbiting scroll member having an orbiting mirror plate and an orbiting spiral vane on one surface of said orbiting mirror plate, said orbiting mirror plate arranged such that said orbiting spiral vane is meshed with said fixed spiral vane of said fixed scroll member, said orbiting scroll member driven by said drive means so as to compress said cooling medium, said drive means including a crankshaft;

a bearing member having a bearing surface for supporting said crankshaft and a bearing surface for supporting said orbiting scroll member;

a thrust bearing disposed on said bearing surface of said bearing member for supporting said orbiting scroll member and having an upper thrust bearing surface supporting an opposite surface of said orbiting mirror plate of said orbiting scroll member, such that said bearing member supports said orbiting scroll member via said thrust bearing;

rotation restriction means for restricting the rotation of said orbiting scroll member, said rotation restriction means comprising a reciprocably movable ring member surrounding said thrust bearing;

an expansion space defined by an inner peripheral surface of said ring member, said opposite surface of said orbiting mirror plate, an outer peripheral surface of said thrust bearing, and said bearing surface of said bearing member, said expansion space expanding and contracting with reciprocal movement of said ring member;

a plurality of oil grooves on said upper thrust bearing surface of said thrust bearing;

means for delivering oil from said oil sump to said oil grooves of said thrust bearing; and expansion space oil supply means for intermittently providing a supply of oil from said plurality of oil grooves on said upper bearing surface of said thrust bearing to said expansion space, said expansion space oil supply means provided on said opposite surface of said orbiting mirror plate of said orbiting scroll member.

2. The scroll compressor as set forth in claim 1, wherein:

said expansion space oil supply means comprises at least one oil recess on said opposite surface of said orbiting mirror plate of said orbiting scroll member.

3. The scroll compressor as set forth in claim 2, wherein:

said orbiting scroll member has an orbiting shaft on said opposite surface of said orbiting mirror plate, said orbiting shaft coupling said orbiting scroll member to said crank shaft; and said expansion space oil supply means comprises a plurality of said oil recesses on said opposite surface of said orbiting mirror plate positioned symmetrically with respect to said orbiting shaft.

4. A scroll compressor for compressing a cooling medium in a refrigerating cycle, comprising:

a closed casing;

a scroll compressor unit provided in said closed casing;

an electric motor in said closed casing for driving said scroll compressor unit;

an oil sump in a lower portion of said closed casing for storing lubricating oil;

a shaft connected between said electric motor and said scroll compressor unit to enable said electric motor to drive said scroll compressor unit, said shaft having a main shaft portion and a crank shaft portion;

said scroll compressor unit dividing the interior of said closed casing into an exhaust space whereat said scroll compressor unit exhausts compressed cooling medium for use in said refrigerating cycle and a suction space for receiving cooling medium to be compressed by said scroll compressor unit, said closed casing having an exhaust pipe extending therethrough and communicating with said exhaust space and a suction pipe extending therethrough and communicating with said suction space, said closed casing further having a hermetic terminal positioned at said suction space for connecting said electric motor to a source of electricity, said scroll compressor unit comprising:

a partition plate dividing said interior of said closed casing into said exhaust space and said suction space;

a fixed scroll member fixed to or unitary with said partition plate, said fixed scroll member having a fixed mirror plate and a fixed spiral vane on one surface of said fixed mirror plate;

an orbiting scroll member having an orbiting mirror plate and an orbiting spiral vane on one surface of said orbiting mirror plate, said orbiting scroll member arranged such that said orbiting spiral vane is meshed with said fixed spiral vane of said fixed scroll member, said orbiting scroll member coupled to said crank shaft portion to enable said electric motor to drive said orbiting scroll member;

a bearing member for supporting said main shaft portion of said crank shaft, said bearing member having an orbiting scroll member bearing surface;

a thrust bearing having an upper bearing surface in contact with an opposite surface of said orbiting mirror plate of said orbiting scroll member, said thrust bearing supported by said bearing surface of said bearing member such that said bearing member supports said orbiting scroll member via said thrust bearing;

a rotation restriction means for restricting the rotation of said orbiting scroll member, said rotation restriction means comprising a reciprocably movable ring member surrounding said thrust bearing, said ring member having a first pair of keys or keyways disposed on one surface of said ring member 180° apart and a second pair of keys or keyways disposed on an opposite surface of said ring 180° apart, said first pair of keys separated from said second pair of keys by 90° along said ring member, said rotation restriction means further comprising a pair of key ways or keys on said opposite surface of said orbiting mirror plate of said orbiting scroll member engaging said first pair of keys or keyways of said ring member and a pair of keyways or keys on said bearing member for engaging said second pair of keys or keyways of said ring member;

an expansion space defined by an inner peripheral surface of said ring member, said opposite surface of said orbiting plate, an outer peripheral surface of said thrust bearing, and said orbiting scroll member bearing surface of said bearing member, said expansion space expanding and contracting with reciprocal movement of said ring member;

an oil passage in said shaft for conducting oil from said oil sump to said crank shaft portion;

a plurality of oil grooves on said upper bearing surface of said thrust bearing;

an oil pump for delivering oil from said oil sump to said crank shaft portion;

oil supply means for conducting oil from said crank shaft portion to said plurality of oil grooves on said upper bearing surface of said thrust bearing;

expansion space oil supply means for intermittently providing a supply of oil from said plurality of oil grooves on said upper bearing surface of said thrust bearing to said expansion space, said expansion space oil supply means provided on said opposite surface of said orbiting mirror plate;

a screening plate in said casing for blocking the flow of cooling medium received in said casing through said suction pipe flowing through said casing in the direction of rotation of said electric motor; and a suction port located near said suction pipe for sucking in cooling medium to be compressed by said compressor unit.

5. The scroll compressor as set forth in claim 4, wherein:

said suction pipe has an open end communicating with said suction space of said casing;

said suction port of said compressor unit is disposed at a position adjacent the position of said open end of said suction pipe in said casing; and said screening plate is disposed at a position in said casing downstream of the position of said open end of said suction pipe with respect to the flow of cooling medium in said casing flowing in the rotational direction of said electric motor.

6. The scroll compressor as set forth in claim 5, wherein:

said expansion space oil supply means comprises at least one oil recess on said opposite surface of said orbiting mirror plate of said orbiting scroll member.

7. The scroll compressor as set forth in claim 6, wherein:

said orbiting scroll member has an orbiting shaft on said opposite surface of said orbiting mirror plate, said orbiting shaft coupling said orbiting scroll member to said crank shaft portion of said shaft; and said expansion space oil supply means comprises a plurality of said oil recesses on said opposite surface of said orbiting mirror plate positioned symmetrically with respect to said orbiting shaft.

8. The scroll compressor as set forth in claim 5, wherein:

said bearing member comprises a plurality of rib members for supporting said orbiting scroll member bearing surface, said screening plate fixed to one of said rib members.

9. The scroll compressor as set forth in claim 8, wherein:

said expansion space oil supply means comprises at least one oil recess on said opposite surface of said orbiting mirror plate of said orbiting scroll member.

10. The scroll compressor as set forth in claim 9, wherein:

said orbiting scroll member has an orbiting shaft on said opposite surface of said orbiting mirror plate, said orbiting shaft coupling said orbiting scroll member to said crank shaft portion of said shaft; and said expansion space oil supply means comprises a plurality of said oil recesses on said opposite surface of said orbiting mirror plate positioned symmetrically with respect to said orbiting shaft.

11. The scroll compressor as set forth in claim 4, wherein:

said bearing member comprises a plurality of rib members for supporting said orbiting scroll member bearing surface, said screening plate fixed to one of said rib members.

12. The scroll compressor as set forth in claim 11, wherein:

said expansion space oil supply means comprises at least one oil recess on said opposite surface of said orbiting mirror plate of said orbiting scroll member.

13. The scroll compressor as set forth in claim 12, wherein:

said orbiting scroll member has an orbiting shaft on said opposite surface of said orbiting mirror plate, said orbiting shaft coupling said orbiting scroll member to said crank shaft portion of said shaft; and said expansion space oil supply means comprises a plurality of said oil recesses on said opposite surface of said orbiting mirror plate positioned symmetrically with respect to said orbiting shaft.

14. A scroll compressor for compressing a cooling medium in a refrigerating cycle, comprising:

a closed casing;

a scroll compressor unit provided in said closed casing;

an electric motor in said closed casing for driving said scroll compressor unit;

an oil sump in a lower portion of said closed casing for storing lubricating oil;

a shaft connected between said electric motor and said scroll compressor unit to enable said electric motor to drive said scroll compressor unit, said shaft having a main shaft portion and a crank shaft portion;

said scroll compressor unit dividing the interior of said closed casing into an exhaust space whereat said scroll compressor unit exhausts compressed cooling medium for use in said refrigerating cycle and a suction space for receiving cooling medium to be compressed by said scroll compressor unit, said closed casing having an exhaust pipe extending therethrough and communicating with said exhaust space and a suction pipe extending therethrough and communicating with said suction space, said closed casing further having a hermetic terminal positioned at said suction space for connecting said electric motor to a source of electricity, said scroll compressor unit comprising:

a suction port located near said suction pipe for sucking in cooling medium to be compressed by said compressor unit;

a partition plate dividing said interior of said closed casing into said exhaust space and said suction space;

a fixed scroll member fixed to or unitary with said partition plate, said fixed scroll member having a fixed mirror plate and a fixed spiral vane on one surface of said fixed mirror plate;

an orbiting scroll member having an orbiting mirror plate and an orbiting spiral vane on one surface of said orbiting mirror plate, said orbiting scroll member arranged such that said orbiting spiral vane is meshed with said fixed spiral vane of said fixed scroll member, said orbiting scroll member coupled to said crank shaft portion to enable said electric motor to drive said orbiting scroll member;

a bearing member for supporting said main shaft portion of said shaft, said bearing member having an orbiting scroll member bearing surface;

a thrust bearing having an upper bearing surface in contact with an opposite surface of said orbiting mirror plate of said orbiting scroll member, said thrust bearing supported be said bearing surface of said bearing member such that said bearing member supports said orbiting scroll member via said thrust bearing;

a rotation restriction means for restricting the rotation of said orbiting scroll member, said rotation restriction means comprising a reciprocably movable ring member surrounding said thrust bearing, said ring member having a first pair of keys or keyways disposed on one surface of said ring member 180° apart and a second pair of keys or keyways disposed on an opposite surface of said ring 180° apart, said first pair of keys separated from said second pair of keys by 90° along said ring member, said rotation restriction means further comprising a pair of key ways or keys on said opposite surface of said orbiting mirror plate of said orbiting scroll member engaging said first pair of keys or keyways of said ring member and a pair of keyways or keys on said bearing member for engaging said second pair of keys or keyways of said ring member;

an expansion space defined by an inner peripheral surface of said ring member, said opposite surface of said orbiting plate, an outer peripheral surface of said thrust bearing, and said orbiting scroll member bearing surface of said bearing member, said expansion space expanding and contracting with reciprocal movement of said ring member;

an oil passage in said shaft for conducting oil from said oil sump to said crank shaft portion;

a plurality of oil grooves on said upper bearing surface of said thrust bearing;

an oil pump for delivering oil from said oil sump to said crank shaft portion;

oil supply means for conducting oil from said crank shaft portion to said plurality of oil grooves on said upper bearing surface of said thrust bearing;

said bearing member additionally having a crank shaft portion bearing portion supporting said crank shaft portion of said shaft;

oil return means between said crank shaft portion of said shaft and said crank shaft portion bearing portion of said bearing member for conducting oil from said plurality of oil grooves on said upper bearing surface of said thrust bearing;

an oil nozzle in said crank shaft portion bearing portion of said bearing member communicating with said oil return means for spouting lubricating oil in said oil return means out to said suction space of said casing; and expansion space oil supply means for intermittently providing a supply of oil form said plurality of oil grooves on said upper bearing surface of said thrust bearing to said expansion space, said expansion space oil supply means provided on said opposite surface of said orbiting mirror plate;

wherein said oil nozzle is positioned in said crank shaft portion bearing portion of said bearing member facing said hermetic terminal, whereby oil spouted out of said oil nozzle is directed against said hermetic terminal.

15. The scroll compressor as set forth in claim 14, wherein:

a screening plate is disposed in said casing between said suction port of said compressor unit and said oil nozzle with respect to the direction of rotation of said electric motor, whereby low of cooling medium entering said casing from said suction pipe and flowing in the rotational direction of said electric motor is interrupted by said screening plate before reaching said oil nozzle.

16. The scroll compressor as set forth in claim 15, wherein:

said suction pipe and said oil nozzle are positioned in said casing so as to be separated approximately 180° from each other.

17. The scroll compressor as set forth in claim 16, wherein:

said expansion space oil supply means comprises at least one oil recess on said opposite surface of said orbiting mirror plate of said orbiting scroll member.

18. The scroll compressor as set forth in claim 17, wherein:

said orbiting scroll member has an orbiting shaft on said opposite surface of said orbiting mirror plate, said orbiting shaft coupling said orbiting scroll member to said crank shaft portion of said shaft; and said expansion space oil supply means comprises a plurality of said oil recesses on said opposite surface of said orbiting mirror plate positioned symmetrically with respect to said orbiting shaft.

19. The scroll compressor as set forth in claim 14, wherein:

said expansion space oil supply comprises at least one oil recess on said opposite surface of said orbiting mirror plate of said orbiting scroll member.

20. The scroll compressor as set forth in claim 19, wherein:

said orbiting scroll member has an orbiting shaft on said opposite surface of said orbiting mirror plate, said orbiting shaft coupling said orbiting scroll member to said crank shaft portion of said shaft; and said expansion space oil supply means comprises a plurality of said oil recesses on said opposite surface of said orbiting mirror plate positioned symmetrically with respect to said orbiting shaft.

21. A scroll compressor for compressing a cooling medium used in a refrigerating cycle, comprising:

a closed casing;

a scroll compressor unit provided in said closed casing;

an electric motor in said closed casing for driving said scroll compressor unit;

an oil sump in a lower portion of said closed casing for storing lubricating oil;

a shaft connected between said electric motor and said scroll compressor unit to enable said electric motor to drive said scroll compressor unit, said shaft having a main shaft portion and a crank shaft portion;

said scroll compressor unit dividing the interior of said closed casing into an exhaust space whereat said scroll compressor unit exhausts compressed cooling medium for use in said refrigerating cycle and a suction space for receiving cooling medium to be compressed by said scroll compressor unit, said closed casing having an exhaust pipe extending therethrough and communicating with said exhaust space and a suction pipe extending therethrough and communicating with said suction space, said closed casing further having a hermetic terminal positioned at said suction space for connecting said electric motor to a source of electricity, said scroll compressor unit comprising:

a suction port located near said suction pipe for sucking in cooling medium to be compressed by said compressor unit;

a partition plate dividing said interior of said closed casing into said exhaust space and said suction space;

a fixed scroll member fixed to or unitary with said partition plate, said fixed scroll member having a fixed mirror plate and a fixed spiral vane on one surface of said fixed mirror plate;

an orbiting scroll member having an orbiting mirror plate and an orbiting spiral vane on one surface of said orbiting mirror plate, said orbiting scroll member arranged such that said orbiting spiral vane is meshed with said fixed spiral vane of said fixed scroll member, said orbiting scroll member coupled to said crank shaft portion to enable said electric motor to drive said orbiting scroll member;

a bearing member for supporting said main shaft portion of said shaft, said bearing member having an orbiting scroll member bearing surface;

a thrust bearing having an upper bearing surface in contact with an opposite surface of said orbiting mirror plate of said orbiting scroll member, said thrust bearing supported by said bearing surface of said bearing member such that said bearing member supports said orbiting scroll member via said thrust bearing;

a rotation restriction means for restricting the rotation of said orbiting scroll member, said rotation restriction means comprising a reciprocably movable ring member surrounding said thrust bearing, said ring member having a first pair of keys or keyways disposed on one surface of said ring member 180° apart and a second pair of keys or keyways disposed on an opposite surface of said ring 180° apart, said first pair of keys separated from said second pair of keys by 90° along said ring member, said rotation restriction means further comprising a pair of keyways or keys on said opposite surface of said orbiting mirror plate of said orbiting scroll member for engaging said first pair of keys or keyways of said ring member and a pair of keyways or keys on said bearing member for engaging said second pair of keys or keyways of said ring member;

an expansion space defined by an inner peripheral surface of said ring member, said opposite surface of said orbiting plate, an outer peripheral surface of said thrust bearing, and said orbiting scroll member bearing surface of said bearing member, said expansion space expanding and contracting with reciprocal movement of said ring member;

an oil passage in said shaft for conducting oil from said oil sump to said crank shaft portion;

a plurality of oil grooves on said upper bearing surface of said thrust bearing;

at least one through hole in said thrust bearing communicating said plurality of oil grooves with the lower surface of said thrust bearing opposite to said upper thrust bearing surface;

an oil pump for delivering oil from said oil sump to said crank shaft portion;

oil supply means for conducting oil from said crank shaft portion to said plurality of oil grooves on said upper bearing surface of said thrust bearing;

expansion space oil supply means for intermittently providing a supply of oil from said plurality of oil grooves on said upper bearing surface of said thrust bearing to said expansion space, said expansion space oil supply means provided on said opposite surface of said orbiting mirror plate;

said orbiting scroll member has an orbiting shaft on said opposite surface of said orbiting mirror plate, said orbiting shaft coupling said orbiting scroll member to said crank shaft portion;

said expansion space oil supply means comprises a plurality of oil recesses on said opposite surface of said orbiting mirror plate positioned symmetrically with respect to said orbiting shaft;

said suction pipe has an open and communicating with said suction space of said casing;

said suction port of said compressor unit is disposed at a position adjacent the position of said open end of said suction pipe in said casing; and said bearing member comprises a plurality of rib members for supporting said orbiting scroll member bearing surface;

a screening plate fixed in said casing on one of said plurality of rib members and provided between said suction port and said hermetic terminal such as to interrupt the flow of cooling medium received in said casing from said suction pipe and flowing in the rotational direction of said electric motor;

said bearing member additionally having a crank shaft portion bearing portion supporting said crank shaft portion of said shaft;

oil return means between said crank shaft portion of said shaft and said crank shaft portion bearing portion of said bearing member for conducting oil from said at least one through hole in said thrust bearing; and an oil nozzle in said crank shaft portion bearing portion of said bearing member communicating with said oil return means for spouting lubricating oil in said oil return means out to said suction space of said casing, said oil nozzle positioned so as to face said hermetic terminal to direct oil spouted out of said oil nozzle against said hermetic terminal, and said oil nozzle positioned so as to be separated approximately 180° from said suction pipe in said casing.

22. A scroll compressor for compressing a cooling medium used in a refrigerating cycle, comprising:

a closed casing;

a scroll compressor unit provided in said closed casing;

an electric motor in said closed casing for driving said scroll compressor unit;

an oil sump in a lower portion of said closed casing for storing lubricating oil;

a shaft connected between said electric motor and said scroll compressor unit to enable said electric motor to drive said scroll compressor unit, said shaft having a main shaft portion and a crank shaft portion;

said scroll compressor unit dividing the interior of said closed casing into an exhaust space whereat said scroll compressor unit exhausts compressed cooling medium for use in said refrigerating cycle and a suction space for receiving cooling medium to be compressed by said scroll compressor unit, said scroll compressor unit comprising:

a partition plate dividing said interior of said closed casing into said exhaust space and said suction space;

a fixed scroll member fixed to or unitary with said partition plate, said fixed scroll member having a fixed mirror plate and a fixed spiral vane on one surface of said fixed mirror plate;

an orbiting scroll member having an orbiting mirror plate and an orbiting spiral vane on one surface of said orbiting mirror plate, said orbiting scroll member arranged such that said orbiting spiral vane is meshed with said fixed spiral vane of said fixed scroll member, said orbiting scroll member coupled to said crank shaft portion to enable said electric motor to drive said orbiting scroll member;

a bearing member for supporting said main shaft portion of said shaft, said bearing member having an orbiting scroll member bearing surface;

a thrust bearing having an upper bearing surface in contact with an opposite surface of said orbiting mirror plate of said orbiting scroll member, said thrust bearing supported by said bearing surface of said bearing member such that said bearing member supports said orbiting scroll member via said thrust bearing;

a rotation restriction means for restricting the rotation of said orbiting scroll member, said rotation restriction means comprising a reciprocably movable ring member surrounding said thrust bearing, said ring member having a first pair of keys or keyways disposed on one surface of said ring member 180° apart and a second pair of keys or keyways disposed on an opposite surface of said ring 180° apart, said first pair of keys separated from said second pair of keys by 90° along said ring member, said rotation restriction means further comprising a pair of keyways or keys on said opposite surface of said orbiting mirror plate of said orbiting scroll member for engaging said first pair of keys or keyways of said ring member and a pair of keyways or keys on said bearing member for engaging said second pair of keys or keyways of said ring member;

an expansion space defined by an inner peripheral surface of said ring member, said opposite surface of said orbiting plate, an outer peripheral surface of said thrust bearing, and said orbiting scroll member bearing surface of said bearing member, said expansion space expanding and contracting with reciprocal movement of said ring member;

an oil passage in said shaft for conducting oil from said oil sump to said crank shaft portion;

a plurality of oil grooves on said upper bearing surface of said thrust bearing;

an oil pump for delivering oil from said oil sump to said crank shaft portion;

oil supply means for conducting oil from said crank shaft portion to said plurality of oil grooves on said upper bearing surface of said thrust bearing;

expansion space oil supply means for intermittently providing a supply of oil from said plurality of oil grooves on said upper bearing surface of said thrust bearing to said expansion space, said expansion space oil supply means provided on said opposite surface of said orbiting mirror plate.

* * * * *